US006499823B2

(12) United States Patent
Okazaki et al.

(10) Patent No.: US 6,499,823 B2
(45) Date of Patent: Dec. 31, 2002

(54) INK JET RECORDING HEAD HAVING SUBSTRATE AND CEILING PLATE BASE PRESSED TOGETHER BY BASE PLATE AND INK SUPPLY MEMBER

(75) Inventors: Takeshi Okazaki, Kanagawa (JP); Shunichi Watanabe, Tokyo (JP); Koichi Omata, Kanagawa (JP); Hirotaka Miyazaki, Kanagawa (JP); Ryo Shimamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/878,234

(22) Filed: Jun. 12, 2001

(65) Prior Publication Data

US 2002/0015081 A1 Feb. 7, 2002

(30) Foreign Application Priority Data

Jun. 15, 2000 (JP) ..... 2000/180344

(51) Int. Cl.[7] ..... B41J 2/015; B41J 2/14; B41J 2/16; B41J 2/05; B41J 2/175

(52) U.S. Cl. ..... 347/20; 347/49; 347/65; 347/93

(58) Field of Search ..... 347/20, 63, 65, 347/56, 85, 49, 45, 93, 89, 87

(56) References Cited

U.S. PATENT DOCUMENTS 5,538,586 A * 7/1996 Swanson et al. ..... 347/20
5,606,352 A 2/1997 Yamakawa et al. ..... 347/20
5,650,805 A * 7/1997 Shimomura et al. ..... 347/20
5,821,962 A * 10/1998 Kudo et al. ..... 347/65
5,826,333 A 10/1998 Iketani et al. ..... 29/890.1
5,933,163 A 8/1999 Koizumi et al. ..... 347/42

FOREIGN PATENT DOCUMENTS

EP 0 661 157 A2 5/1995 ..... B41J/2/16
JP 10-157112 6/1998 ..... B41J/2/05

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head includes a substrate having an element surface provided with energy generating elements, a ceiling plate provided with a grooved surface having grooves to become ink passages, the grooved surface and the element surface being bonded to form the ink passages, a base plate for supporting the substrate from the side opposite the element surface, and an ink supply member in contact with the base plate at a contact portion and having an ink flow path wall face to be communicated with the ink passage. The base plate and the ink supply member pinch the substrate and the ceiling plate at the contact portion as a fulcrum so as to enable the base plate to press the substrate from the side opposite the element surface, and the ink supply member to press the ceiling plate from the side opposite the grooved surface.

56 Claims, 8 Drawing Sheets

INK JET RECORDING HEAD HAVING SUBSTRATE AND CEILING PLATE BASE PRESSED TOGETHER BY BASE PLATE AND INK SUPPLY MEMBER

BACKGROUND OF THE INVENTION

1. Field of the Invention

The present invention relates to an ink jet recording head adoptable for use in wide industrial fields, which is not only applicable to an office use printer, but also, to a printer capable of printing on cloths, coloring base plate for color filter use, and some other recording medium. The invention also relates to a method for manufacturing such ink jet recording head. More particularly, the invention relates to an ink jet recording head for which an elongation is designed for the discharge energy generating element substrate, as well as to a method for manufacturing such ink jet recording head.

2. Related Background Art

The structure of the conventional ink jet recording head itself for which an elongation is designed is substantially the same as the structure of the conventional ink jet recording head which is formed comparatively short. As shown in FIG. 8, on a base plate 106, a heater board 204 is installed with discharge energy generating elements (not shown) such as electrothermal converting devices or the like, and on it, is further installed a ceiling plate 205 formed by silicon, resin, or the like which is provided with fine groove patterns thereon. The heater board 204 and the ceiling plate 205 are bonded or held down by use of a spring unit after a process of ceiling plate bonding. As shown in FIG. 9, the ceiling plate 205 is provided with an SUS rod which penetrates it in the longitudinal direction in order to secure the straightness thereof.

The ink, which is supplied through a filter (not shown) installed in a supply unit 201 for removing dust particles or the like, is allowed to flow in an SUS pipe 202 provided for a head cover 203, and supplied from the ink jet recording head side into the ink flow paths which are formed by adhesively bonding the heater board 204 and the ceiling plate 205. Then, the discharge energy generating elements provided for the heater board 204 supply discharge energy to ink in accordance with electric signals from the PWB 208 which is a printed base board for exchanging electric signals with a recording apparatus (not shown). In other words, when the discharge energy generating elements are electrothermal converting devices, ink is heated to be bubbled, and ink is discharged by means of pressure exerted by this bubbling.

In this way, recording is made by discharging ink to a recording medium. However, when the ink jet recording head operates continuously, the temperature of the head itself is caused to rise, and may produce unfavorable effect on recording in some cases. To counteract this, the base plate 106 is provided with heat radiating function, and it is formed by metallic material, such as aluminum alloy die-casting material, which has excellent mechanical property, machinability, and forgeability in addition to good thermal conductivity. Also, the surface of the base plate 106 is treated with anodized aluminum to provide erosion resistivity to prevent it from being eroded by ink.

Also, the recording apparatus having an ink jet recording head mounted thereon performs the recovery operation to remove ink adhering to the discharge surface by use of a blade to brash off the discharge surface on which discharge ports are formed to discharge ink from the ink jet recording head, thus stabilizing the discharge characteristics.

However, the elongated conventional ink jet recording head is structured so that the spring unit is added to hold down the ceiling plate and heater board with each other, besides the supply path for supplying ink, which is arranged above the ceiling plate. As a result, the number of components is increased, and the step of manufacturing processes is also increased eventually.

Also, in some cases, the countermeasures have not been taken sufficiently as to the straightness in the longitudinal direction, the prevention of thermal distortion that may take place on the structural members due to the temperature rise characteristic of an elongated head, as well as the deformation of head caused by the linear expansion difference of materials affected by the changes of environmental temperature. For example, the metallic material, such as aluminum, used for the base plate has a large thermal expansion coefficient, and is subjected to easier deformation by temperature changes. As a result, warping may occur in the mode of head in some cases.

Now, therefore, it is considered useful to select a material having a smaller thermal expansion coefficient, such as isotropic graphite, for the base plate material used for a printing head of as high as 600 dpi. The isotropic graphite has dually such characteristics as being strong against heat and chemicals, besides light in weight.

Nevertheless, the isotropic graphite has intergranular or inner texture defects or contains in it pores and microscopic cracks. As a result, the isotropic graphite has a high water absorption, and absorbs ink adhering to it eventually. Thus, on the surface of blading plane of the isotropic graphite which is brushed off by a blade, a considerable amount of ink is absorbed, and if the amount of ink thus absorbed reaches the critical state, ink is exuded, on the contrary, from the surface of the blading plane to wet it. Then, if the amount of ink which is brushed off exceeds the allowable amount after repeated recovery, ink cannot be brushed off completely, hence creating a problem that the recovery operation cannot be executed sufficiently.

Also, the intergranular binding power of isotropic graphite is small to make it easier to create carbon particles on the surface thereof, and processed plane as well, which of course brings about the creation of dust particles, and also, causes cut-offs or cracks when handling it for assembling or installation. Further, for that matter, a threaded female hole is subjected to being broken if screwed with an intensified value of torque, which necessitates a margin up for the strength of thread cutting.

Furthermore, beside the problems discussed above, the bubbles which are created in the ink supply path are stagnated at the filter portion or the ink supply or recovery efficiency of pressurized ink is reduced eventually.

SUMMARY OF THE INVENTION

It is an object of the present invention to provide an ink jet recording head for which the straightness is secured in the longitudinal direction without increasing the number of components, and a method for manufacturing such ink jet recording head.

It is another object of the invention to provide an ink jet recording head which does not impede the recovery operation thereof, and a method for manufacturing such ink jet recording head.

The ink jet recording head of the present invention comprises a substrate having the element surface provided with energy generating elements for generating energy to be used for discharging ink; a ceiling plate provided with the grooved surface having grooves to become ink passage corresponding to the energy generating elements, the grooved surface and the element surface being bonded to form the ink passage; a base plate for supporting the substrate from the side opposite to the element surface; and an ink supply member being in contact with the base plate at a contact portion, having the ink flow path wall face to be communicated with the ink passage. For this recording head, the base plate and the ink supply member pinch the substrate and the ceiling plate at the contact portion as a fulcrum so as to enable the base plate to press the substrate from the side opposite to the element surface, and the ink supply member to press the ceiling plate from the side opposite from the grooved surface.

For the ink jet recording head of the invention thus structure, the member that enables the ceiling plate and the substrate to be closely in contact, and the member for supplying ink are arranged to be commonly functional as an ink supply member. As a result, it becomes possible to omit the provision of any spring member to be used only for keeping the close contact of the ceiling plate and the substrate, thus curtailing the number of parts.

Also, for the ink jet recording head of the present invention, it may be possible to fix the ink supply member and the base plate member by use of screws to enable them to be in close contact with each other at the contact portion or to fix the ink supply member and the base plate member by adhesively bonding them with each other at the contact portion. In the case of adhesive bonding, in particular, it is possible to omit screws for fixing use.

Also, the ink jet recording head of the present invention may be the one in which the printed base plate for controlling the energy generating elements is installed on the base plate on the side that supports the substrate so as not to intervene in the contact between the ink supply member and the base plate, and the surface of the base plate for installing the printed base plate may be formed at a position lower than the surface for supporting the substrate. With the structure thus arranged, it becomes possible to preferably effectuate wire bonding by making the height of wire bonding substantially the same between the printed base plate and the substrate particularly when wire bonding is adopted to electrically connect the substrate and the printed base plate which is thicker than the substrate.

Also, the ink jet recording head of the invention may be the one which further comprises an ink supply second member having an ink supply path communicated with the ink flow path by being bonded to the ink supply member. The ink supply second member and the base plate may be in close contact and fixed by use of screws or my be bonded with each other and fixed.

Also, a filter may be installed in the ink supply path to make the ink flow-in direction substantially upward vertically. The filter may be provided in a plurality, and of the plural filters, the ink passing area of the filter installed in the ink supply path for supplying ink from the outside to the ink passage is larger than the ink passing area of the filter installed in the ink supply path for returning ink from the ink passage to the outside. In this case, it becomes possible for the bubbles that flow together with ink to utilize floating force and pass each of the filters easily, thus preventing the ink flow from being blocked by the stagnation of bubbles on the flow-in side of each of the filters. Also, with the passing area of ink of the filter on the return side being made smaller in agreement with the reduced pressure of flowing ink, it becomes possible to apply pressure to the bubbles in the filter on the return side to enable them to pass through the filter. In this manner, the designing elements required for the recovery system on the recording apparatus side can be reduced accordingly.

Also, the contact portion of the ink supply members themselves may be sealed with an O-ring or with sealant.

Further, the ink passage may be airtightly closed essentially with the exception of the communication port of the ink flow path and discharge port for discharging ink. In this case, ink in the ink passage is not allowed to be in contact with external sealant or the like.

Also, the contact portion of the ink flow path and the communication port may be sealed with an O-ring or with sealant.

Also, above the energy generating element, a valve may be integrally formed with the substrate, and the free end of this valve is in the direction toward the discharge port for discharging ink and the fixing end in the direction opposite to that direction.

Also, for the ink jet recording head of the invention, the energy generating element is an electrothermal converting device for generating thermal energy. The ink supply member and the base plate are formed by the same material, and the substrate and the ceiling plate are formed by the same material. Then, the difference between the linear expansion coefficients of the ink supply member and the base plate, and the linear expansion coefficients of the substrate and the ceiling plate may be arranged so as not to allow intervention in the valve and the wall face of the ink passage even if a pitch deviation is created by the heat generated by the electrothermal converting device in the arrangement direction of the discharge port for discharging ink. In this case, even if a pitch deviation is created between the substrate and the ceiling plate by being pulled by the linear expansion of the base plate, for example, the valve and the ink passage wall face do not intervene with each other, hence making it possible to prevent the discharge characteristics from being deteriorated. Also, the ink supply member and the base plate are formed by the same material, and the substrate and the ceiling plate are formed by the same material. Then, the difference between the linear expansion coefficients of the ink supply member and the base plate, and the linear expansion coefficients of the substrate and the ceiling plate may be made smaller than the difference between the linear expansion coefficient of metal and the linear expansion coefficients of the substrate and the ceiling plate.

The ink supply member may be provided with thermal conductivity capable of preventing harmful effects due to thermal shocks from the electrothermal converting device, and the base plate may be provided with thermal conductivity capable of preventing harmful effects due to thermal shocks from the electrothermal converting device. In this case, it becomes possible to prevent each member from the compositional deformation or distortion due to thermal shock that may be given to each structural member when the temperature of the entire body of the ink jet recording head is caused to rise in operating a solid recording or the like.

Also, the ink supply member and the base plate may be formed by carbon graphite. Then, this formation is anticipated to contribute to making the ink jet head lighter in weight, besides obtaining the thermal characteristics described earlier.

Also, for the ink jet recording head of the invention, the face of the ink supply member and that of the base plate which form the surface having discharge ports for discharging ink may be provided with water repellency. In this case, it becomes possible to prevent the defective recovery operation due to the ink permeation into the surface where discharge ports are formed.

A protection layer may be formed substantially on the entire outer surfaces of the ink supply member and the base plate in order to block ink impregnation.

Also, the inner defects, pores, and microscopic cracks of the ink supply member and the base plate may be impregnated with liquid agent that permeates them. In this case, with the liquid agent being hardened, the binding force between particles is intensified to provide the function of increasing the margin of the preventions of chipping, carbon dust particles, breakage of threads on the tapped portions.

The method of the present invention for manufacturing an ink jet recording head, which is provided with a substrate having the element surface with energy generating elements formed thereon for generating energy to be used for discharging ink; a ceiling plate having the grooved surface with grooves to become ink passage corresponding to the energy generating elements, the grooved surface and the element surface being bonded to form the ink passage; a base plate for supporting the substrate from the side opposite to the element surface; and an ink supply member being in contact with the base plate at a contact portion, having the ink flow path wall face to be communicated with the ink passage, comprises the steps of preparing an ink supply member having the ink flow path wall face to be communicated with the ink passage; bonding the ink supply member and the base plate; and pinching the substrate and the ceiling plate with the base plate and the ink supply member for contacting them closely by pressing the substrate with the base plate from the side opposite to the element surface, and pressing the ceiling plate with the ink supply member from the side opposite to the grooved surface.

With the method for manufacturing an ink jet recording head of the invention thus structured, it is possible to prepare the member for supplying ink and the member for enabling the ceiling plate and the substrate to be closely in contact to be commonly functional as the ink supply member. Therefore, not only a step of installing the spring member which is used only for maintaining the ceiling plate and the substrate to be in close contact can be omitted, but also, the cost reduction, the simplification of the apparatus, and the processing yield can be enhanced.

This method for manufacturing an ink jet recording may comprise further the step of preparing a ink supply second member having the ink supply path communicated with the ink flow path by being bonded to the ink supply member. Also this method may further comprise the step of forming a protection layer for blocking the ink permeation substantially on the entire outer surface of the ink supply member and the base plate. Further, the method may comprise the step of coating with water repellent agent the face of the ink supply member and the face of the base plate to form the surface provided with discharge ports for discharging ink after the completion of the step of forming the protection layer.

BRIEF DESCRIPTION OF THE DRAWINGS

FIG. 3A is a side sectional view, and FIG. 3B is a front sectional view.

DETAILED DESCRIPTION OF THE PREFERRED EMBODIMENTS

Now, with reference to the accompanying drawings, the embodiment of the present invention will be described.

Figure 1:
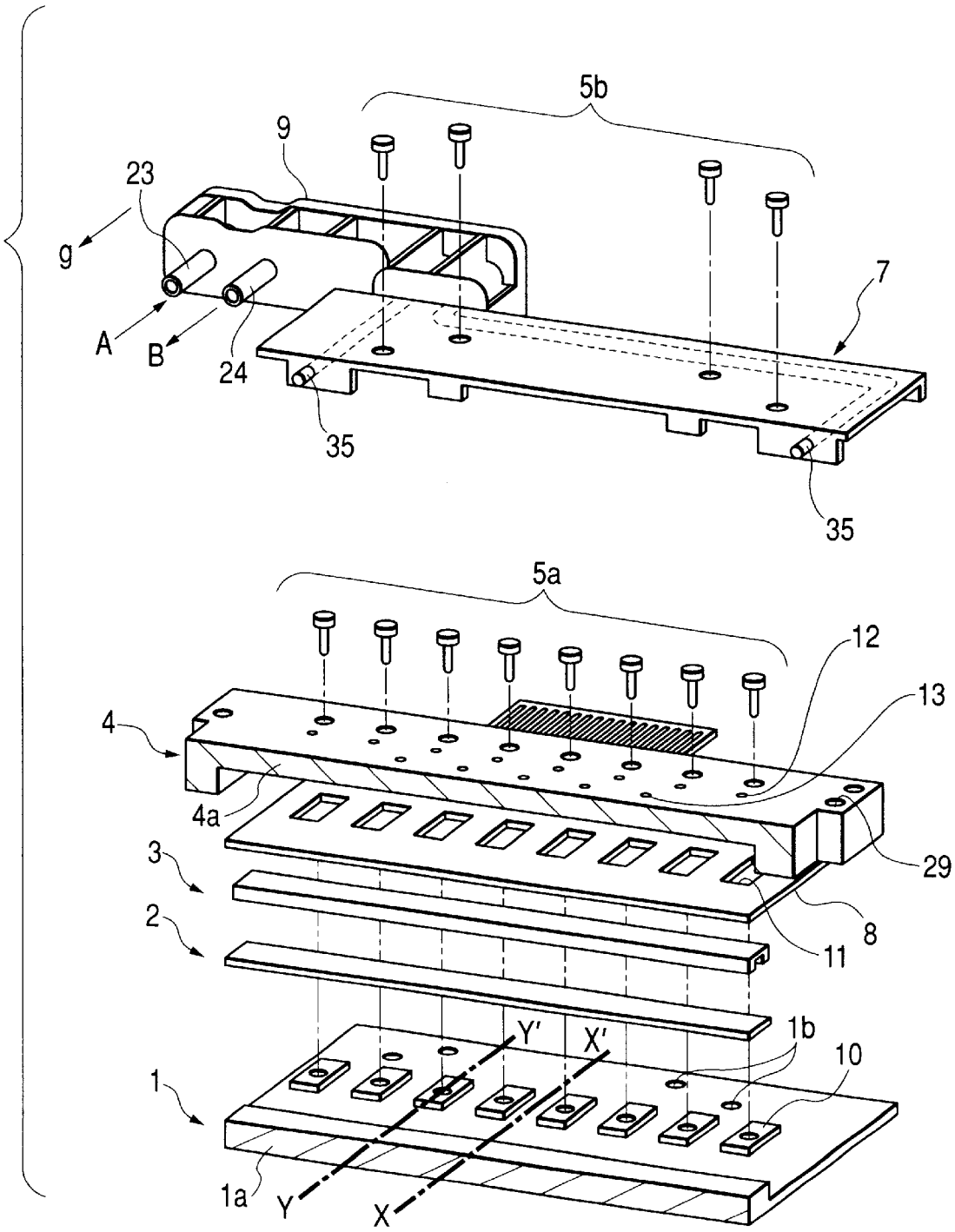
FIG. 1 is an exploded perspective view which shows an ink jet recording head in accordance with one embodiment of the present invention.
Figure 2:
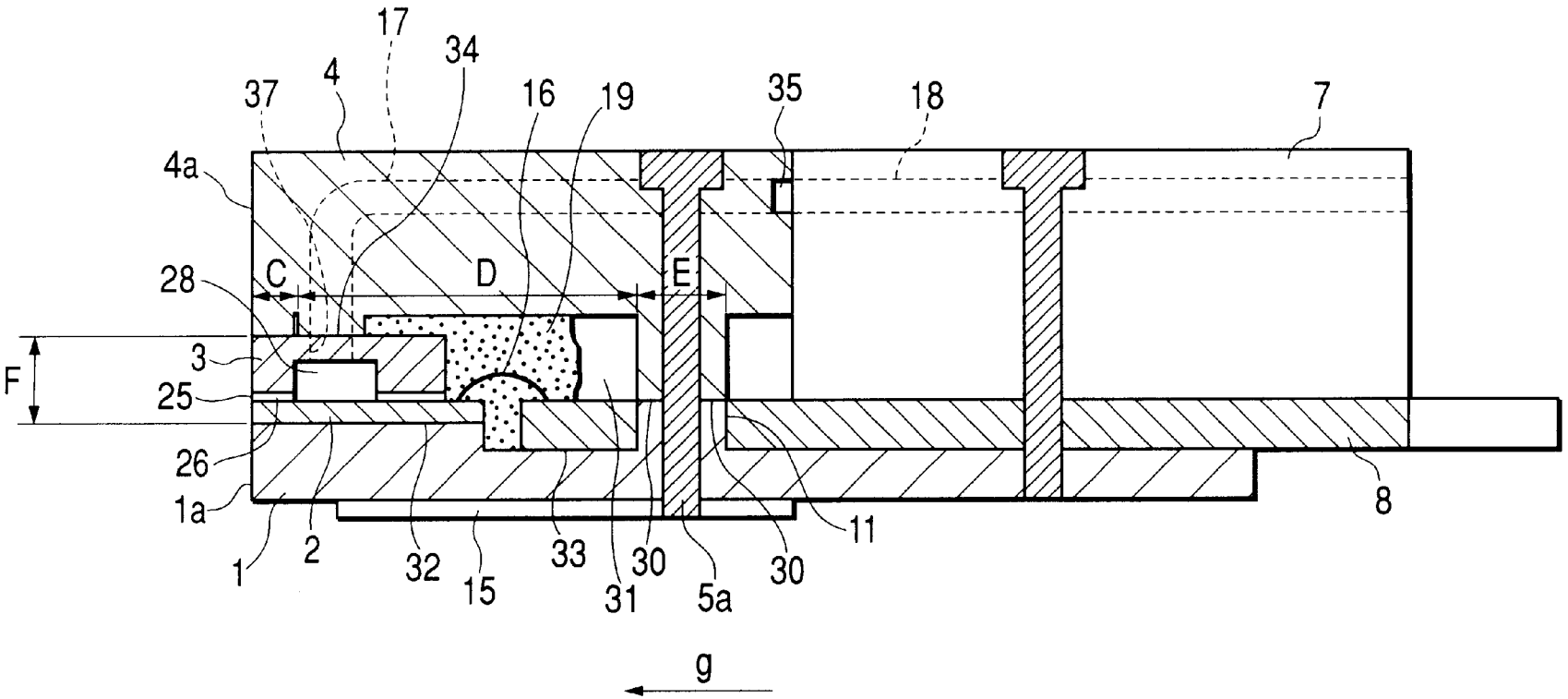
FIG. 2 is a side sectional view which shows the ink jet recording head represented in FIG. 1.
Figure 3A:
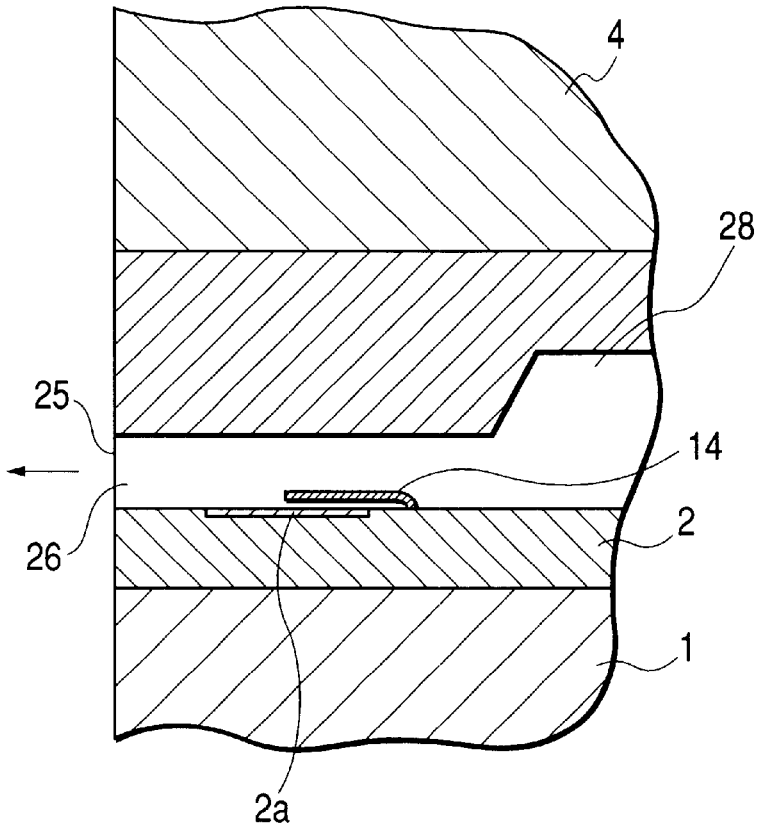
FIGS. 3A and 3B are views which illustrate the circumference of an ink path of the ink jet recording head represented in FIG. 1.
Figure 3B:
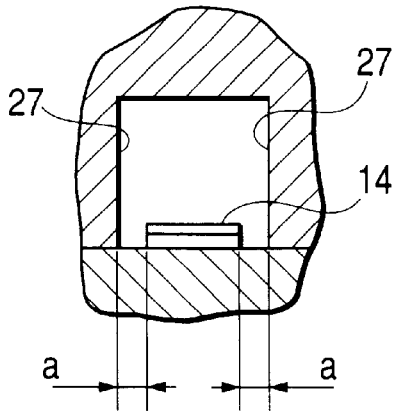

FIG. 1 is an exploded perspective view which shows an ink jet recording head in accordance with one embodiment of the present invention. FIG. 2 is a side sectional view which shows the ink jet recording head, taken in line Y–Y' in FIG. 1. FIGS. 3A and 3B are views which illustrate the circumference of an ink path of the ink jet recording head represented in FIG. 1; FIGS. 4A to 4D are views which illustrate the area for a ceiling plate and a base plate where coating agent is impregnated, and the area therefor where water repellent agent is impregnated.

Figure 4A:
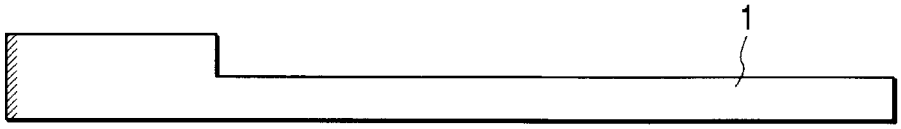
FIGS. 4A, 4B, 4C and 4D are views which illustrate the area for a ceiling plate and a base plate where coating agent is impregnated, and the area therefor where water repellent agent is impregnated.
Figure 4B:
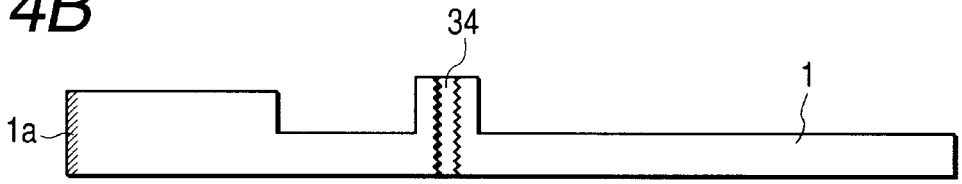
Figure 4C:
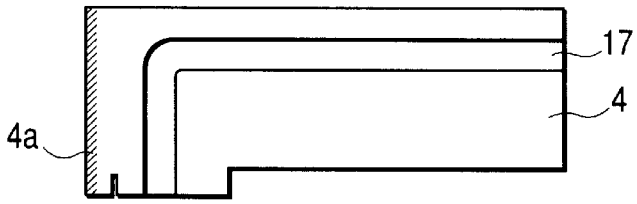
Figure 4D:
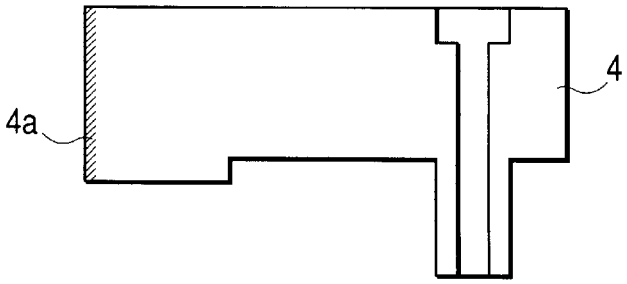

Here, in FIG. 2, the filter box 9 of the ink supply second member 7 is omitted. Also, FIG. 4A is a cross-sectional view of the base plate 1, taken along line X–X' in FIG. 1. FIG. 4B is a cross-sectional view of the ink supply member 4, taken along line Y–Y'. FIG. 4C is a cross-sectional view of the portion of the ink supply member 4 where the ink flow path 17 is formed. FIG. 4D is a cross-sectional view of the portion of the ink supply member 4 which corresponds to the base plate 1 represented in FIG. 4B. Also, an arrow g in each of FIGS. 4A to 4D indicates the gravitational direction.

The ink jet recording head of the present embodiment is provided with the base plate 1 which is formed by carbon graphite, and the HB 2 which is a silicon heater board having discharge energy generating elements 2*a*, such as electrothermal converting devices, and each of the valves (see FIG. 3A) for stabilizing discharges which is installed above each discharge energy generating element. This head is further provided with the PWB 8 which is a printed base plate connected electrically with the HB 2 by wires 16, as well as the silicon ceiling plate 3 for which a plurality of fine grooves are formed. In addition, the head is provided with the carbon graphite ink supply member 4 having the ink flow path 17 communicate the communication port 37 of the common liquid chamber 28 of the ceiling plate 3, and the ink supply second member 7 having the filter box 9, and the ink supply path 18 formed to communicate with the ink supply member 4.

The base plate 1 is formed so that the surface of the PWB 33 having the PWB 8 installed thereon is lower than the surface of the HB 32 having the HB 2 installed thereon. In this way, the height of the plane where the wire bonding is effectuated for the HB 2 and the PWB 8 which is thicker than the HB 2 becomes even to make the wire bonding in good condition. However, the shape of the base plate 1 may be flat without any step between the HB surface 32 side and the PWB surface 33 if the structure is not such as to install the PWB 8 on the HB surface 32 side of the base plate 1 as in the present embodiment.

Also, the surface of the base plate 1 which is indicated by hatching in FIG. 4A, namely, the entire surface thereof is impregnated with polyimide resin solution for coating. With this coating by polyimide resin solution, the base plate 1 is prevented from ink permeation.

Further, the blading plane 1*a* (the area indicated by netting in FIG. 4A) which is brushed off by a blade 20 to be described later, is coated with water repellent agent. In this respect, the blading plane 1*a* is coated with water repellent agent in such a manner that the aforesaid polyimide resin solution is coated before water repellent agent is applied so as to make it easier for the water repellent agent to be applied, and then, the water repellent agent is coated, because if the water repellent agent is applied to the carbon graphite directly, it is absorbed from the surface, and the surface cannot be provided with a sufficient water repellency after all. After the coating of the water repellent agent, the blading plane 1*a* is cured at 150° C. for three hours or more. In this way, the blading plane 1*a* is provided with water repellency.

Further, as indicated by hatching in FIG. 4B, the surface of the base plate 1 where the threaded hole 34 is cut to provide a female thread is impregnated with PSF (polysulfone) solution for coating. Here, as described later, when the ink supply second member 7 is installed on the base plate 1 by means of a screw 5*b*, a threaded hole (not shown) for receiving this screw 5*b* is impregnated with PSF solution for coating. With the PSF solution coating, the cutting strength of thread is increased to prevent the thread from being broken or cracked.

There are provided respectively for the ink supply member 4, five holes 13 for use of holding the ceiling plate at the time of bonding the ceiling plate, through each of which a pin passes for provisionally holding the ceiling plate 3 on the ceiling plate bonding machine when it is bonded; eight holes 12 for use of wire bonding seal to seal with sealant 19 the wire bonded locations between the HB 2 and the PWB 8; and three fixing holes 29 on the left and right for use of fixation to a recording apparatus (not shown). In FIG. 1, one fixing hole 29 is formed on the left side, and two on the right side. This is because with one of the holes on the left side, it is intended to make the positional adjustment to the left and right.

Also, the surface of the ink supply member 4 and the ink flow path 17 indicated by hatching in FIG. 4C, that is, the entire surface of the ink supply member 4 is impregnated with polyimide resin solution for coating. With this coating of polyimide resin solution, ink can be prevented from being permeated into the ink supply member 4. Further, the blading plane 4*a* (the area indicated by netting in FIG. 4C) is coated with water repellent agent.

In this respect, as the polyimide resin solution used for coating the base plate 1 and the ink supply member 4*b*, the one having the ratio of polyimide:solvent=1:0.8 may be usable, and as the water repellent agent, the one having CTX809A:Ctsolve=1:4 (weight ratio) may be usable. Also, as the PSF solution, tetrahydro furan is used as solvent, and solution of 5% weight ratio (PSF tetrahydro furan=5 g:95 g) may be usable. However, if the concentration of PSF solution is intensified by increasing the PSF weight for solution, the graphite base material, namely, carbon graphite is not impregnated with the solution, and the surface is filmed eventually to make it inadequate.

The ink supply member 4 and the base plate 1 are closely in contact with each other on the fulcrum 30 which is the circumference of the screw 5*a* as shown in FIG. 2, and fixed by use of eight screws 5*a*. The screw 5*a* may be a binding screw of M2. For the ink supply member 4, a gap 31 is formed between the contact surface which becomes the fulcrum 30, and the ceiling plate surface 34 that exerts pressure on the ceiling plate 3 when being in contact with the upper face of the ceiling plate 3.

In this respect, an O-ring or sealant may be used for sealing for the coupling portion between the ink flow path 17 and the communication port 37.

Also, for example, in order to contact the ceiling plate 3 and the HB 2 closely by a pressure of 3 kg per screw 5*a* in accordance with the feedback result of examination using the spring material of the elongated conventional head, it is found preferable to make the dimension C 0.8 mm, the dimension D 12 mm, and the dimension E 5.5 mm in FIG. 2 if the length of an elongated head is made approximately 100 mm with the interval between each of the screws 5*a* being approximately 14 mm. Or instead of using screws 5*a*, it may be possible to adhesively bond and fix the ink supply member 4 and the base plate 1 on the fulcrum 30 which is the coupling portion between the ink supply member 4 and the base plate 1. In this case, the screws 5*a* are not needed and the number of parts can be curtailed.

The ink supply second member 7 may be formed by Noryl (NORYL: product name, manufactured by the Engineering Plastics (EPL), Inc), which is in the surface contact with the PWB 8, and closely fixed by the base plate 1, and four M2 binding screws 5*b*. Or instead of using screws 5*b*, the ink supply second member 7 and the base plate 1 may be adhesively bonded for fixation. In this case, the screws 5*b* are no longer needed, and the number of parts can be curtailed.

The ink supply path 18 formed for the ink supply second member 7 is communicated with the ink flow path 17 with the extruded hole 35 which is fitted into the ink flow path 17, and the fitting portion is cut off from the outside by the bonding using sealant. In this respect, an O-ring (not shown) is pinched between the ink supply member 4 and the ink supply second member 7 so as to seal the circumference of the extruded hole 35. Then, through such O-ring, the ink supply member 4 and the ink supply second member 7 may be fixed.

Figure 5:
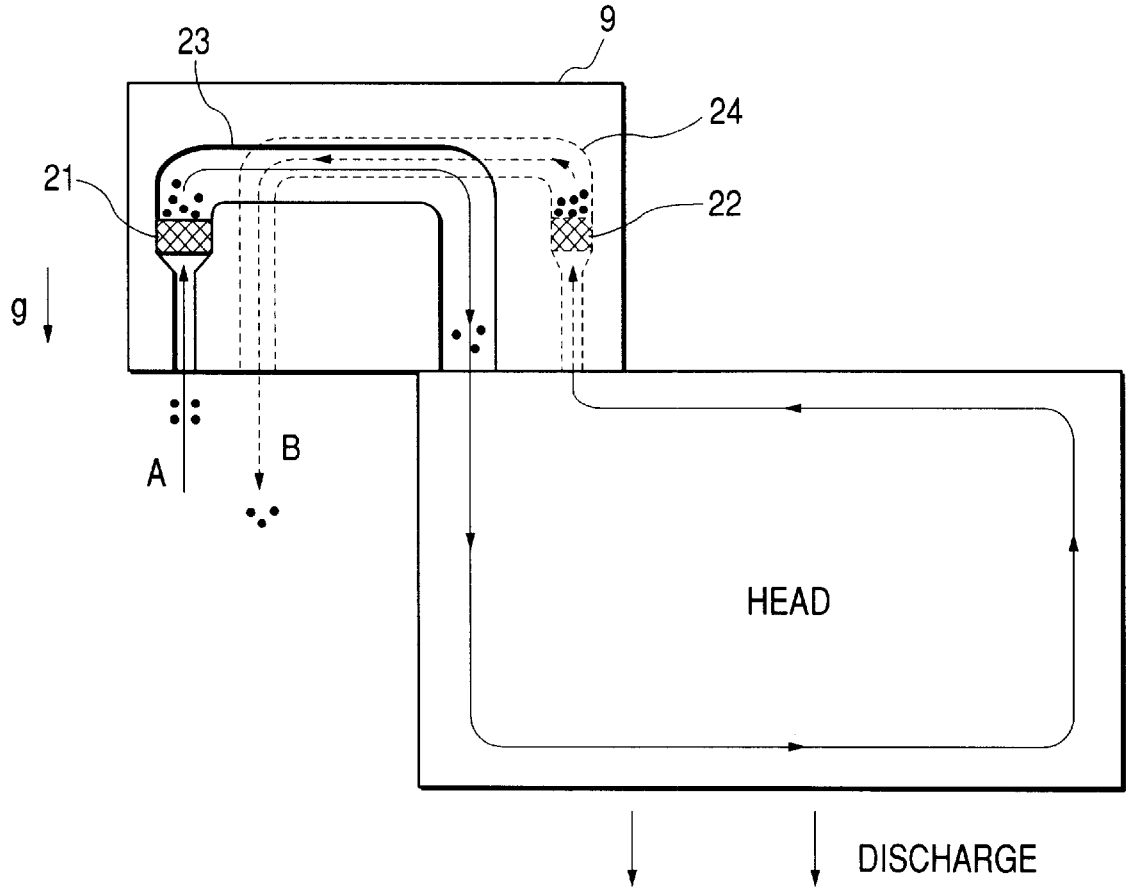
FIG. 5 is a view which schematically shows each of the filters installed in a filter box.

The other end side of the ink supply path 18 facing the extruded hole 35 is communicated with the supply path 23 indicated by solid line in the filter box 9 shown in FIG. 5, and also, with the return path 24 which is indicated by broken line. In the supply path 23 and the return path 24, a filter 21 on the supply side and a filter 22 on the return side are arranged, respectively. The filter 21 on the supply side has a large area for ink to pass than that of the filter 22 on the return side. The ink jet recording head of the present embodiment is structured in the assumption that ink is discharged in the vertical direction indicated by an arrow g in FIG. 5 when it is mounted on a recording apparatus. Therefore, the arrangement is made to set the ink passage in the filter 21 on the supply side and the filter 22 on the return side to be placed upward under any circumstances when ink is supplied from the recording apparatus to the ink jet recording head or ink is returned from the ink jet recording head to the recording apparatus.

In other words, when ink is supplied from the recording apparatus to the ink jet recording head, bubbles that flow into it together with ink to be supplied can easily penetrate the filter 21 on the supply side, because the passage area of the filter 21 on the supply side is larger, while the flow of ink is upward in the vertical direction, and the floating force of bubbles can be utilized. As a result, there is no possibility that bubbles from the outside are stagnated on the filter 21 on the flow-in side to hinder the ink supply.

On the other hand, the ink which is drawn together with bubbles is circulated in the head, and returned to the recording apparatus again as recycling ink. In this case, bubbles are let out from the discharge ports 25, and those bubbles which remain undischarged are arranged to pass the filter 22 on the return side on the way in the return passage of ink from the ink jet recording head to the recording apparatus side. At this juncture, too, ink and bubbles pass the filter 22 on the return side upward in the vertical direction. Therefore, the bubbles can easily pass the filter 22 on the return side. However, since the pressure becomes smaller immediately before passing the filter 22 on the return side to the extent that ink is let out from the discharge ports 25, the diameter of the filter 22 on the return side is made smaller than that of the filter 21 on the supply side in agreement with the reduced ink pressure. In this way, the bubble releasing becomes easier even if the ink pressure is made smaller when ink and bubbles pass the filter 22 on the return side.

With the double filter structure of the ink supply second member 7 and the control of the ink circulating directions, it becomes possible to avoid recovery defects due to the presence of bubbles, and to effectuate bubble releasing even with a smaller recovery pressure. Hence, the amount of ink used for recovery can be reduced as compared with the amount conventionally used, and the designing elements can also be made smaller when design consideration is given to the recovery system on the recording apparatus side.

The PWB 8 is used for controlling each of the discharge energy generating elements, and bonded with the HB 2 by use of wire 16 which is gold wire for exchanging electric signals with the recording apparatus. For the PWB 8 installed on the base plate 1 on the HB surface 32 side, a through hole 11 is formed to penetrate the extrusion 10, which is positioned to face the extrusion 10 of the base plate 1 so as not to intervene with the close contact between the ink supply member 4 and the base plate 1.

The HB 2 is made in such as manner that silicon oxide film or silicon nitride film is formed on the silicon substrate or the like for the purpose of insulation and heat accumulation, and then, on such film, the electrically resistive layer and wiring are patterned to constitute electrothermal converting devices which serve as discharge energy generating elements. Electric power and electric signals from the recording apparatus are supplied to the electrically resistive layer through the PWB 8, the wire 16, and the wiring formed on the HB 2. In this way, the discharge energy generating elements are heated. The valve 14 which is installed integrally with the HB 2 is provided with a free end on the discharge port 25 side, and a fixed end on the common liquid chamber 28 side as shown in FIG. 3A.

The ceiling plate 3 constitutes a plurality of nozzles (ink paths) 26 corresponding to each of the discharge energy generating elements, and the common liquid chamber 28 whereby ink is supplied to each of the nozzles 26. Then, when the nozzle wall (ink path wall) 27 is formed for the nozzles 26, the liquid chamber frame (not shown) is formed simultaneously and its height is made equal to the height of the nozzle wall 27. In this way, when the ceiling plate 3 is closely in contact with the HB 2, the common liquid chamber 28 is essentially in a closed condition with the exception of the communication port 37 which communicates with the ink flow path 17, and the discharge port 25. Consequently, the sealant 19 (which will be described later) is not allowed to be in contact with the ink. Also, since the ceiling plate 3 is closely in contact with the HB 2 but not bonded by use of an adhesive agent, no adhesive agent is in contact with the ink in this structure. Here, the nozzle 26 and the common liquid chamber 28 are given referred to generically as an "ink passage".

Figure 7:
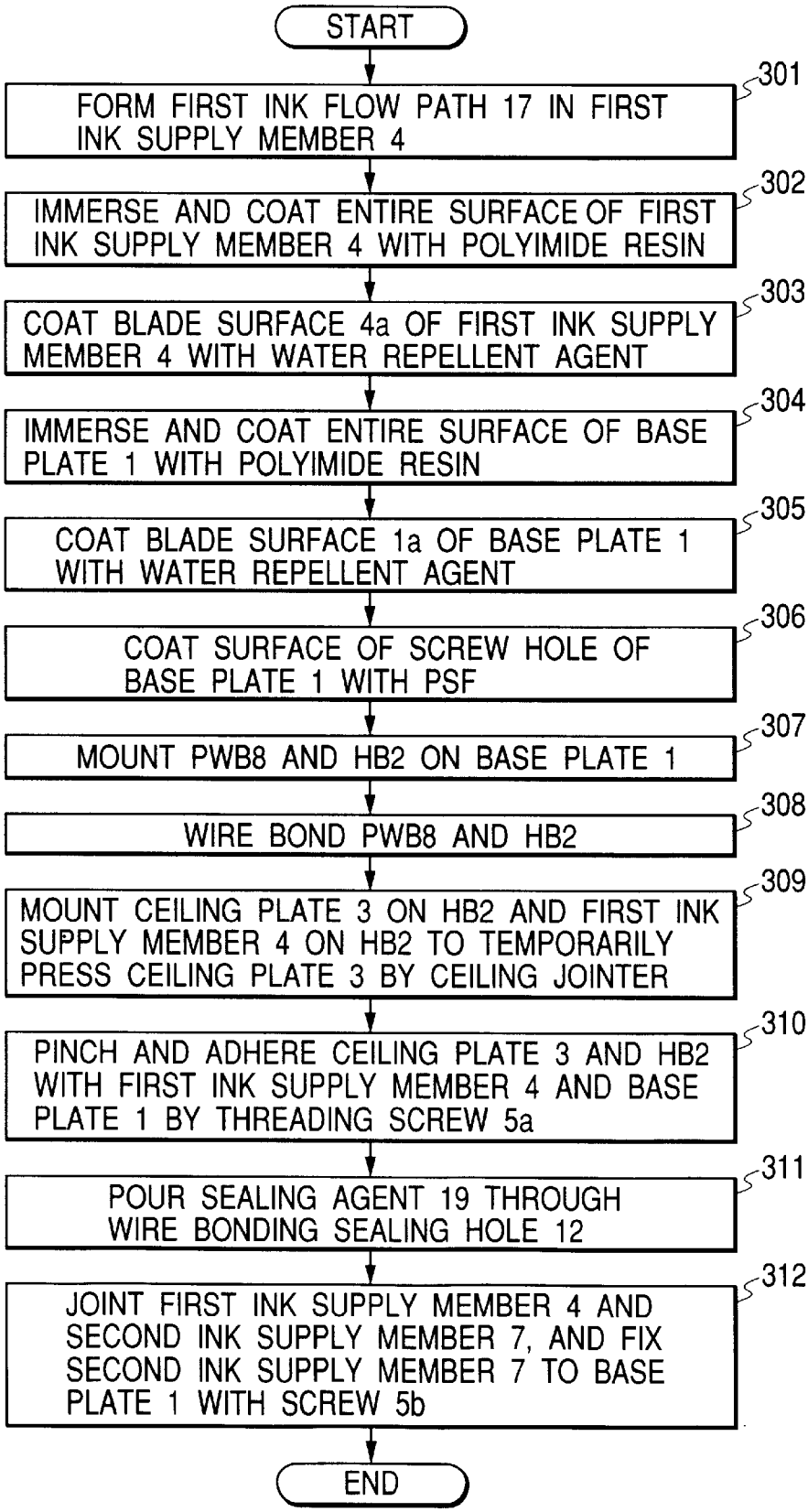
FIG. 7 is a flowchart which describes the outline of a method for manufacturing an ink jet recording head in accordance with the present embodiment of the invention.
Figure 8:
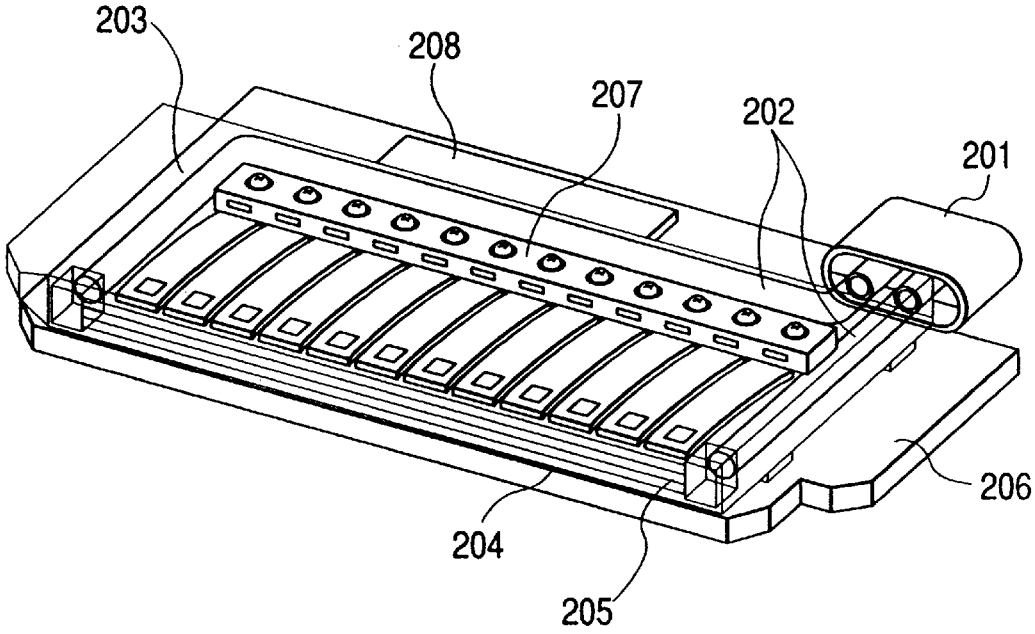
FIG. 8 PRIOR ART
FIG. 8 is a perspective view which shows one example of the elongated conventional ink jet recording head.
Figure 9:
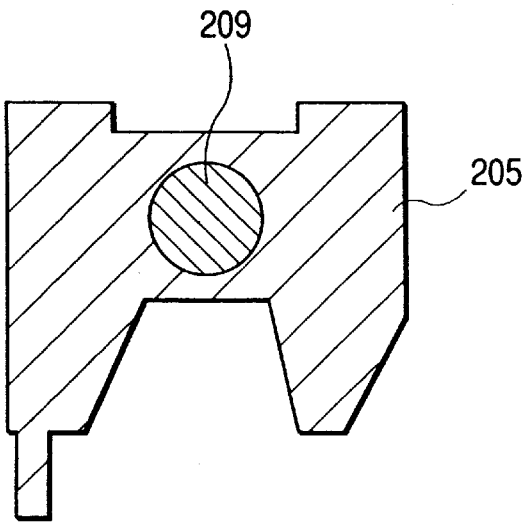
FIG. 9 PRIOR ART
FIG. 9 is a side sectional view which shows a ceiling plate used for the conventional ink jet recording head.

Next, in conjunction with a flowchart shown in FIG. 7, the description will be made of the outline of a method for manufacturing an ink jet recording head embodying the present invention.

Here, in the following description of each manufacturing step, the order thereof may be changeable with the exception of the step in which each of the blading planes is coated with water repellent agent subsequent to the step in which polyimide resin solution is impregnated for coating when the surface treatment is given to the ink supply member 4 and the base plate 1.

At first, the ink flow path 17 is formed for the carbon graphite ink supply member 4 (step 301). Then, the entire surface of the ink supply member 4 is impregnated with polyimide resin solution for coating (step 302). Further, the blading plane 4*a* is coated with water repellent agent (step 303). Likewise, the entire surface of the base plate 1 is impregnated with polyimide resin solution for coating (step 304). The blading plane 1*a* is coated with water repellent agent (step 305). Further, the surface of threaded hole 34 of the base plate 1 is impregnated with PSF solution for coating (step 306).

Subsequently, the PWB 8 is adhesively bonded by use of adhesive tape to the PWB surface 33 of the base plate 1, and then, the HB 2 is bonded onto the HB surface 32 (step 307). Thus, the wire 16 is bonded to the HB 2 and the PWB 8 in order to electrically connect them (step 308).

Next, the ceiling plate 3 is mounted on the HB 2, and the ink supply member 4 is arranged thereon, thus provisionally holding the ceiling plate 3 by use of the ceiling plate bonding machine with the pin being passed through the hole 13 of the ink supply member 4 for use of holding the ceiling plate at the time of bonding it (step 309).

Then, the screw 5*a* is tightened to enable the ink supply member 4 and the base plate 1 to pinch the ceiling plate 3 and the HB 2 between them for close contact (step 310).

Next, sealant 19 is poured into the wire bonding sealing hole 12 of the ink supply member 4 (step 311).

Lastly, the ink supply member 4 and the ink supply second member 7 are bonded, and the ink supply second member 7 is fixed by means of the screws 5*b* to the base plate 1 (step 312), thus completing the manufacturing steps of the ink jet recording head.

As described above, the ink jet recording head embodying the present invention is structured so that on the ceiling plate surface 34, the ink supply member 4 presses the ceiling plate 3 from the side opposite to the face that forms the nozzles 26 of the ceiling plate 3 at the fulcrum 30 which is the contact portion for the ink supply member 4 and the base plate 1 abut against each other, and that the base plate 1 presses the HB 2 on the HB surface 32 from the side opposite to the surface where the discharge energy generating elements are installed on the HB 2 so as to pinch the ceiling plate 3 and the HB 2 between the ink supply member 4 and the base plate 1 to keep them in close contact.

Also, in the ink jet recording head of the present embodiment structured as described above, when the discharge energy generating elements are heated, thermal activation occurs on ink in the bubble generating area between each electrothermal converting device and valve 14, hence generating each bubble on the electrothermal converting device to grow it on the basis of film boiling phenomenon. The pressure that follows the bubble growth acts upon the valve 14 priory to enable the free end of the valve 14 to be displaced to open largely to the discharge port 25 side. Then, depending on the status of the valve 14 which is being displaced or has been displaced, the propagation of pressure exerted by the creation of bubble or the growth of the bubble itself is conducted to the discharge port 25 side, thus discharging ink from the discharge port 25.

As described above, with the heat radiating function provided for the ink supply member 4 and ink supply second member 7 formed by the carbon graphite which is excellent in thermal conductivity for the ink jet recording head of the present embodiment that discharges ink with heating to be accompanied, it is possible to prevent the compositional deformation or distortion due to thermal shock given to each of the structural members by the temperature rise of the entire head of the ink jet recording head in the execution of soil recording or the like.

Also, if the ink supply member 4 and the base plate 1 are formed by carbon graphite, the linear expansion coefficient thereof is $3.8\times10^{-6}\cdot\alpha/K^{-1}$, and if the HB 2 and the ceiling plate 3 are formed by silicon, the linear expansion coefficient thereof is $2.6\times10^{-6}\cdot\alpha/K^{-1}$. The difference between these linear expansion coefficients is only $1.2\times10^{-6}\cdot\alpha/K^{-1}$, which is smaller than the difference between the linear expansion coefficients of the HB 2 and ceiling plate 3, and the linear expansion coefficient of metal. Here, the linear expansion coefficient is given as $\alpha=(1/1_0)$ (dl/dt), and the $1_0$ is a length at zero degree and l is a length at t° C. The difference of the linear expansion coefficients of $1.2\times10^{-6}\cdot\alpha/K^{-1}$ between these two kind of materials may result only in a stretching difference of 3.3 $\mu$m on one side in the longitudinal direction even if the length of the ink jet recording head of the present embodiment is approximately 100 mm as an elongated head, for example, while the change of environmental temperature is upto 55° C. at the maximum $\Delta t$. This difference is not considered to present any hinderance to the head structure at all. In other words, when the environmental temperature may change to 55° C., for example, at the maximum at $\Delta t$ against the length of the ink jet recording head in the nozzle array direction, the discharge function of the ink jet recording head is not affected by the pitch deviation or the like. Then, there is no intervention, either, between the valve 14 and the nozzle wall 27, because the pitch deviation b in the nozzle array direction, which is created between the ceiling plate 3 and HB 2 with the HB 2 being pulled by the linear expansion of the base plate 1, and the clearance a provided for the valve 14 and the nozzle wall 27 of the nozzle 26 are, as shown in FIG. 3B, in the relationship of b<a. Here, the clearance a may be 3.7 $\mu$m. Also, the aforesaid $\Delta t$ may be such as to allow a margin of 20° C. to the environmental temperature of the recording apparatus in actual use within the temperature range that guarantees operation accompnied by the head temperature rise. Further, carbon graphite is light in weight to make the total weight of an ink jet recording apparatus lighter. With this light weight advantage in view, it becomes possible to give more freedom in designing such operability as to enable an ink jet recording head to scan more efficiently or the like or to ease the shock that may be given to the entire ink jet recording head should the head be caused to fall in handling.

The SUS plate 15 is used preferably for installing the ink jet recording head of the present embodiment to a recording apparatus.

Figure 6:
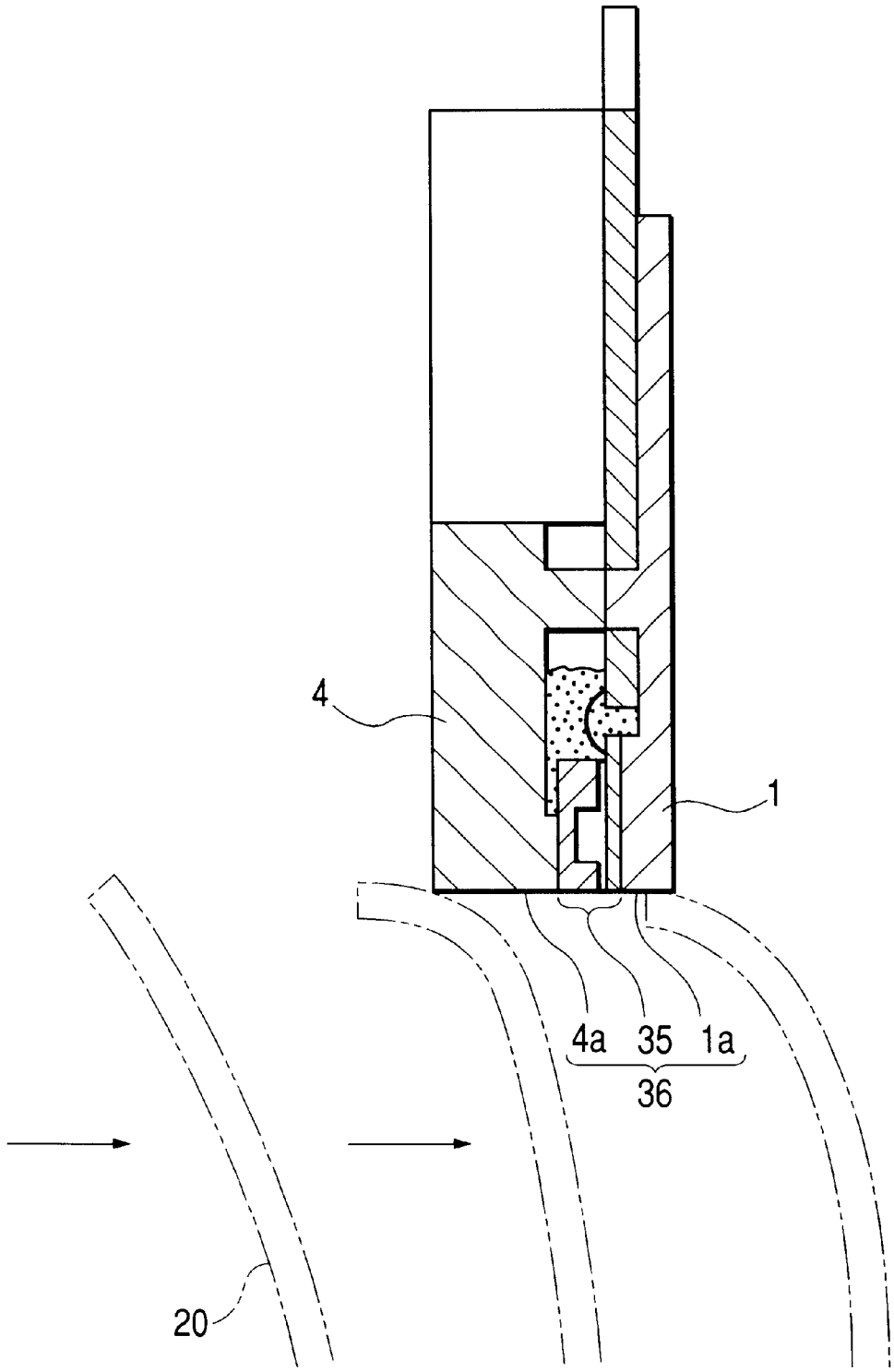
FIG. 6 is a view which illustrates the recovery operation by a brash-off blade.

FIG. 6 is a view which shows the wiping recovery operation using a blade for the ink jet recording head structure as described above.

With the ink mist which is generated when ink is discharged from the ink jet recording head, the satellite ink which is generated when ink is refilled, or the like, wet ink may adhere to the discharge surface 35 in some cases. Also, at the time of recovery process such as ink suction form the discharge port 25, sucking residual ink may adhere to the discharge surface 35 in some cases.

Now, therefore, as the recovery operation to remove such adhesion of ink to the discharge port surface, suction is given to compulsorily expel ink from the discharge port 25, and wiping is performed by use of a blade 20, which is formed by an elastic member or the like, to clean off the discharge surface 35.

The wiping is performed by enabling the blade 20 to be in contact directly with the blading plane 4*a*, the discharge surface 35, and the blading plane 1*a* which form the discharge port surface 36 to slidably rub it while moving relatively in order to clean the discharge port 25 and the circumference thereof, hence securing the discharge stability. The blading plane 4*a* and blading plane 1*b* are coated with water repellent agent, and ink is permeated into the blading plane 4*a* and blading plane 1*b*, thus making it possible to prevent the recovery operation from becoming insufficient due to the ink permeation into the blading plane 4*a* and blading plane 1*b*.

In this respect, it may be possible to make the thickness of the bonded ceiling plate 3 and HB 2 larger by 0.1 mm than the distance F between the HB surface 32 and the ceiling plate surface 34 shown in FIG. 2. In this case, the base plate 1 is conditioned to be warped by 0.1 mm to the side opposite to the ink supply member 4. In this condition, the ceiling plate 3 and HB 2 are maintained in a state of being assuredly in close contact.

As described above, in accordance with the ink jet recording head embodying the present invention, the HB 2 and ceiling plate 3 are pinched in between the carbon graphite ink supply member 4 provided with ink flow path, and the base plate 1. Thus no spring unit or the like is needed to curtail the number of parts. Also, it becomes possible to provide both the ink supply member 4 and the base plate 1 with heat radiating function in order to protect the ink jet recording head from thermal shock.

Also, with the blading plane 4*a* of the ink supply member 4, and the blading plane 1*b* of the base plate 1 being coated with water repellent agent, it is possible to prevent the recovery operation from becoming insufficient due to the ink permeation to the blading plane 4*a* and blading plane 1*b*. Further, the threaded holes for the screws 5*a* and 5*b* to be threaded are coated with PSF solution to make it possible to prevent the threads formed on the threaded holes from being broken or cracked.

Further, for the filter box 9 having a filter 22 on the return side and a filter 21 on the supply side, it is arranged to install the filter 22 on the return side, as well as the filter 21 having a larger area than the filter 22 to allow ink to pass, upward in the vertical direction under any circumstance. As a result, bubbles that flow together with ink can easily pass each of the filters, thus preventing ink flow from being impeded due to the stagnation of bubbles on the flow-in side of each filter.

Also, the common liquid chamber of the elongated conventional head is structured by use of liquid resist in order to be insulated from the outside or the ribless area is sealed for the so-called grooved ceiling plate type. Such a mode requires a bonding process or sealant is allowed to be in contact with ink. Then, under the environment of long term use, the eluted substance due to reaction with ink may clog discharge ports, among some other drawback. Not only the manufacturing steps become complicated, but also, there is a danger that market trouble is invited. For the ink jet recording head of the present embodiment, however, the pattern of the liquid chamber frame 38 is formed at the same height as that of the grooves for discharging ink when the grooves are formed at the same time in the photolithographic process as the method for insulating the common liquid chamber 28 from the outside, hence making it possible to insulate the chamber from the outside without any bonding when the head is assembled. Also, as holding means, the circumference of the common liquid chamber 28 is sealed, but this sealing is executed at the same time that the wire bonding unit is sealed. Thus, no additional processing step is needed. Also, there is no possibility that the sealant thus used can never flow into the common liquid chamber 28, hence avoiding such market trouble as described above.

What is claimed is:

1. An ink jet recording head comprising:

a substrate having an element surface provided with energy generating elements for generating energy to be used for discharging ink;

a ceiling plate provided with a grooved surface having grooves to become ink passages corresponding to said energy generating elements, said grooved surface and said element surface being bonded to form said ink passages;

a base plate for supporting said substrate from a side opposite to said element surface; and an ink supply member being in contact with said base plate at a contact portion, having an ink flow path wall face to be communicated with said ink passages, wherein said base plate and said ink supply member pinch said substrate and said ceiling plate at said contact portion as a fulcrum so as to enable said base plate to press said substrate from the side opposite to said element surface, and said ink supply member to press said ceiling plate from a side opposite from said grooved surface, and wherein said ink supply member and said base plate are formed of the same material, and said substrate and said ceiling plate are formed of the same material, and the difference between the linear expansion coefficients of said ink supply member and said base plate, and the linear expansion coefficients of said substrate and said ceiling plate is smaller than the difference between the linear expansion coefficient of metal and the linear expansion coefficients of said substrate and said ceiling plate.

2. An ink jet recording head according to claim 1, wherein said ink supply member and said base plate are in close contact and fixed by use of screws at said contact portion.

3. An ink jet recording head according to claim 2, further comprising:

an ink supply second member having an ink supply path communicated with an ink flow path by being bonded to said ink supply member.

4. An ink jet recording head according to claim 3, wherein said ink supply second member and said base plate are in close contact and fixed by use of screws.

5. An ink jet recording head according to claim 3, wherein said ink supply second member and said base plate are bonded with each other and fixed.

6. An ink jet recording head according to claim 3, wherein a filter is installed in said ink supply path to make an ink flow-in direction substantially upward vertically.

7. An ink jet recording head according to claim 6, wherein said filter is provided in a plurality, and for each of said plural filters, an ink passing area of said filter installed in said ink supply path for supplying ink from the outside to said ink passages is larger than an ink passing area of said filter installed in said ink supply path for returning ink from said ink passages to the outside.

8. An ink jet recording head according to claim 3, wherein the bonding portion of said ink supply member and said second ink supply member is sealed with an O-ring.

9. An ink jet recording head according to claim 3, wherein the bonding portion of said ink supply member and said second ink supply member is sealed with sealant.

10. An ink jet recording head according to claim 1, wherein said ink supply member and said base plate are bonded with each other and fixed at said contact portion.

11. An ink jet recording head according to claim 10, further comprising:

an ink supply second member having an ink supply path communicated with an ink flow path by being bonded to said ink supply member.

12. An ink jet recording head according to claim 11, wherein said ink supply second member and said base plate are in close contact and fixed by use of screws.

13. An ink jet recording head according to claim 11, wherein said ink supply second member and said base plate are bonded with each other and fixed.

14. An ink jet recording head according to claim 11, wherein a filter is installed in said ink supply path to make an ink flow-in direction substantially upward vertically.

15. An ink jet recording head according to claim 14, wherein said filter is provided in a plurality, and for each of said plural filters, an ink passing area of said filter installed in said ink supply path for supplying ink from the outside to said ink passages is larger than an ink passing area of said filter installed in said ink supply path for returning ink from said ink passages to the outside.

16. An ink jet recording head according to claim 11, wherein the bonding portion of said ink supply member and said second ink supply member is sealed with an O-ring.

17. An ink jet recording head according to claim 11, wherein the bonding portion of said ink supply member and said second ink supply member is sealed with sealant.

18. An ink jet recording head according to claim 1, further comprising a printed base plate for controlling said energy generating elements, wherein said base plate has a side for supporting said substrate, and said printed base plate is installed on said side of said base plate for supporting said substrate so as not to intervene in the contact between said ink supply member and said base plate.

19. An ink jet recording head according to claim 18, wherein a surface of said base plate for installing said printed base plate is formed at a position lower than a surface of said base plate for supporting said substrate.

20. An ink jet recording head according to claim 19, further comprising:

an ink supply second member having an ink supply path communicated with an ink flow path by being bonded to said ink supply member.

21. An ink jet recording head according to claim 20, wherein said ink supply second member and said base plate are in close contact and fixed by use of screws.

22. An ink jet recording head according to claim 20, wherein said ink supply second member and said base plate are bonded with each other and fixed.

23. An ink jet recording head according to claim 20, wherein a filter is installed in said ink supply path to make an ink flow-in direction substantially upward vertically.

24. An ink jet recording head according to claim 23, wherein said filter is provided in a plurality, and for each of said plural filters, an ink passing area of said filter installed in said ink supply path for supplying ink from the outside to said ink passages is larger than an ink passing area of said filter installed in said ink supply path for returning ink from said ink passages to the outside.

25. An ink jet recording head according to claim 23, wherein the bonding portion of said ink supply member and said second ink supply member is sealed with an O-ring.

26. An ink jet recording head according to claim 23, wherein the bonding portion of said ink supply member and said second ink supply member is sealed with sealant.

27. An ink jet recording head according to claim 18, further comprising:

an ink supply second member having an ink supply path communicated with an ink flow path by being bonded to said ink supply member.

28. An ink jet recording head according to claim 27, wherein said ink supply second member and said base plate are in close contact and fixed by use of screws.

29. An ink jet recording head according to claim 27, wherein said ink supply second member and said base plate are bonded with each other and fixed.

30. An ink jet recording head according to claim 27, wherein a filter is installed in said ink supply path to make an ink flow-in direction substantially upward vertically.

31. An ink jet recording head according to claim 30, wherein said filter is provided in a plurality, and for each of said plural filters, an ink passing area of said filter installed in said ink supply path for supplying ink from the outside to said ink passages is larger than an ink passing area of said filter installed in said ink supply path for returning ink from said ink passage to the outside.

32. An ink jet recording head according to claim 27, wherein the bonding portion of said ink supply member and said second ink supply member is sealed with an O-ring.

33. An ink jet recording head according to claim 27, wherein the bonding portion of said ink supply member and said second ink supply member is sealed with sealant.

34. An ink jet recording head according to claim 1, further comprising:

an ink supply second member having an ink supply path communicated with an ink flow path by being bonded to said ink supply member.

35. An ink jet recording head according to claim 34, wherein said ink supply second member and said base plate are in close contact and fixed by use of screws.

36. An ink jet recording head according to claim 34, wherein said ink supply second member and said base plate are bonded with each other and fixed.

37. An ink jet recording head according to claim 34, wherein a filter is installed in said ink supply path to make an ink flow-in direction substantially upward vertically.

38. An ink jet recording head according to claim 37, wherein said filter is provided in a plurality, and for each of said plural filters, an ink passing area of said filter installed in said ink supply path for supplying ink from the outside to said ink passages is larger than an ink passing area of said filter installed in said ink supply path for returning ink from said ink passages to the outside.

39. An ink jet recording head according to claim 34, wherein the bonding portion of said ink supply member and said second ink supply member is sealed with an O-ring.

40. An ink jet recording head according to claim 34, wherein the bonding portion of said ink supply member and said second ink supply member is sealed with sealant.

41. An ink jet recording head according to claim 1, wherein each of said ink passages is essentially airtightly closed except for a communication port of an ink flow path and a discharge port for discharging ink.

42. An ink jet recording head according to claim 41, wherein a contact portion of said ink flow path and said communication port is sealed with an O-ring.

43. An ink jet recording head according to claim 41, wherein a contact portion of said ink flow path and said communication port is scaled with sealant.

44. An ink jet recording head according to claim 1, wherein said energy generating elements are electrothermal converting devices for generating thermal energy.

45. An ink jet recording head according to claim 44, further comprising a plurality of valves provided above said energy generating elements, respectively, wherein said ink supply member and said base plate are formed of the same material, and said substrate and said ceiling plate are formed of the same material, and the difference between the linear expansion coefficients of said ink supply member and said base plate, and the linear expansion coefficients of said substrate and said ceiling plate is such as to prevent said valves and wall faces of said respective ink passages from interfering with each other even if a pitch deviation is created by heat generated by said electrothermal converting devices in an arrangement direction of said discharge ports.

46. An ink jet recording head according to claim 44, wherein said ink supply member is provided with thermal conductivity capable of preventing harmful effects due to thermal shocks from said electrothermal converting devices.

47. An ink jet recording head according to claim 44, wherein said base plate is provided with thermal conductivity capable of preventing harmful effects due to thermal shocks from said electrothermal converting devices.

48. An ink jet recording head comprising:

a substrate having an element surface provided with energy generating elements for generating energy to be used for discharging ink;

a ceiling plate provided with a grooved surface having grooves to become ink passages corresponding to said energy generating elements, said grooved surface and said element surface being bonded to form said ink passages;

a base plate for supporting said substrate from a side opposite to said element surface; and an ink supply member being in contact with said base plate at a contact portion, having an ink flow path wall face to be communicated with said ink passages, wherein said base plate and said ink supply member pinch said substrate and said ceiling plate at said contact portion as a fulcrum so as to enable said base plate to press said substrate from the side opposite to said element surface, and said ink supply member to press said ceiling plate from a side opposite from said grooved surface, and wherein above each of said energy generating elements, a valve having a free end in a direction toward a discharge port for discharging ink and a fixed end in a direction opposite to the direction toward said discharge port is integrally formed with said substrate.

49. An ink jet recording head according to claim 48, wherein each of said energy generating elements is an electrothermal converting device for generating thermal energy.

50. An ink jet recording head according to claim 49, wherein said ink supply member and said base plate are formed of the same material, and said substrate and said ceiling plate are formed of the same material, and the difference between the linear expansion coefficients of said ink supply member and said base plate, and the linear expansion coefficients of said substrate and said ceiling plate is such as to prevent said valves and wall faces of said respective ink passages from interfering with each other even if a pitch deviation is created by heat generated by said electrothermal converting devices in an arrangement direction of said discharge ports.

51. An ink jet recording head according to claim 49, wherein said ink supply member is provided with thermal conductivity capable of preventing harmful effects due to thermal shocks from said electrothermal converting devices.

52. An ink jet recording head according to claim 49, wherein said base plate is provided with thermal conductivity capable of preventing harmful effects due to thermal shocks from said electrothermal converting devices.

53. An ink jet recording head comprising:

a substrate having an element surface provided with energy generating elements for generating energy to be used for discharging ink;

a ceiling plate provided with a grooved surface having grooves to become ink passages corresponding to said energy generating elements, said grooved surface and said element surface being bonded to form said ink passages;

a base plate for supporting said substrate from a side opposite to said element surface; and an ink supply member being in contact with said base plate at a contact portion, having an ink flow path wall face to be communicated with said ink passages, wherein said base plate and said ink supply member pinch said substrate and said ceiling plate at said contact portion as a fulcrum so as to enable said base plate to press said substrate from the side opposite to said element surface, and said ink supply member to press said ceiling plate from a side opposite from said grooved surface, and wherein said ink supply member and said base plate are formed of carbon graphite.

54. An ink jet recording head according to claim 53, wherein a face of said ink supply member and a face of said base plate for forming a surface having discharge ports for discharging ink are provided with water repellency.

55. An ink jet recording head according to claim 53, wherein a protection layer for blocking ink impregnation is formed on substantially the entire outer surfaces of said ink supply member and said base plate.

56. An ink jet recording head according to claim 53, wherein inner defects, pores, and microscopic cracks of said ink supply member and said base plate are impregnated with a liquid agent permeating the inner defects, pores and microscopic cracks.

* * * * *

UNITED STATES PATENT AND TRADEMARK OFFICE

CERTIFICATE OF CORRECTION

PATENT NO. : 6,499,823 B2
DATED : December 31, 2002
INVENTOR(S) : Takeshi Okazaki et al.

It is certified that error appears in the above-identified patent and that said Letters Patent is hereby corrected as shown below:

Column 3,
Line 18, "structure," should read -- structured, --; and
Line 52, "my" should read -- may --.

Column 11,
Line 30, "$1.2x10^{-6\neq}\alpha/K^{-1}$," should read -- $1.2x10^{-6,}\alpha/K^{-1}$, --;
Line 42, "upto" should read -- up to --; and
Line 59, "accompnied" should read -- accompanied --.

Column 15,
Line 10, "claim 23," should read -- claim 20, --; and
Line 13, "claim 23," should read -- claim 20, --.

Signed and Sealed this

Seventh Day of October, 2003

JAMES E. ROGAN
*Director of the United States Patent and Trademark Office*